US009067443B2

(12) United States Patent
Kobayashi

(10) Patent No.: US 9,067,443 B2
(45) Date of Patent: Jun. 30, 2015

(54) IMAGE FORMING APPARATUS AND METHOD FOR DISCHARGING A MEDIUM

(71) Applicant: Oki Data Corporation, Tokyo (JP)

(72) Inventor: Taisei Kobayashi, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 14 days.

(21) Appl. No.: 13/965,586

(22) Filed: Aug. 13, 2013

(65) Prior Publication Data

US 2014/0050512 A1 Feb. 20, 2014

(30) Foreign Application Priority Data

Aug. 15, 2012 (JP) ..... 2012-180216

(51) Int. Cl.
*B41J 11/42* (2006.01)
*B41J 25/00* (2006.01)

(52) U.S. Cl.
CPC . *B41J 25/00* (2013.01); *B41J 11/42* (2013.01)

(58) Field of Classification Search
CPC ..... B41J 11/42; B41J 11/425; B41J 25/00; B41J 11/44; B41J 13/00; B41J 13/0009
USPC ..... 400/76, 16, 17
See application file for complete search history.

(56) References Cited

U.S. PATENT DOCUMENTS 7,566,124 B2 * 7/2009 Kan et al. ..... 347/104

FOREIGN PATENT DOCUMENTS

JP H04-152164 A 5/1992
JP H06-030210 2/1994

* cited by examiner

*Primary Examiner* — David Banh
(74) *Attorney, Agent, or Firm* — Rabin & Berdo, P.C.

(57) ABSTRACT

An image forming apparatus is capable of placing a line feed operation on hold. A memory holds an amount of line feed and discharge direction information. A controller parses the printer control data, and detects the position of the print medium based on the detection signal. An image forming section prints on the print medium while transporting the print medium. When the discharge direction information indicates a direction opposite to a direction in which the print medium is line fed. When the position of a final printed area on a page of print medium is within the page of the print medium, if a line feed is performed, the controller adds a new amount of line feed to the amount of line feed in the memory, and then places the resultant amount of line feed on hold.

12 Claims, 12 Drawing Sheets

FIRST EMBODIMENT

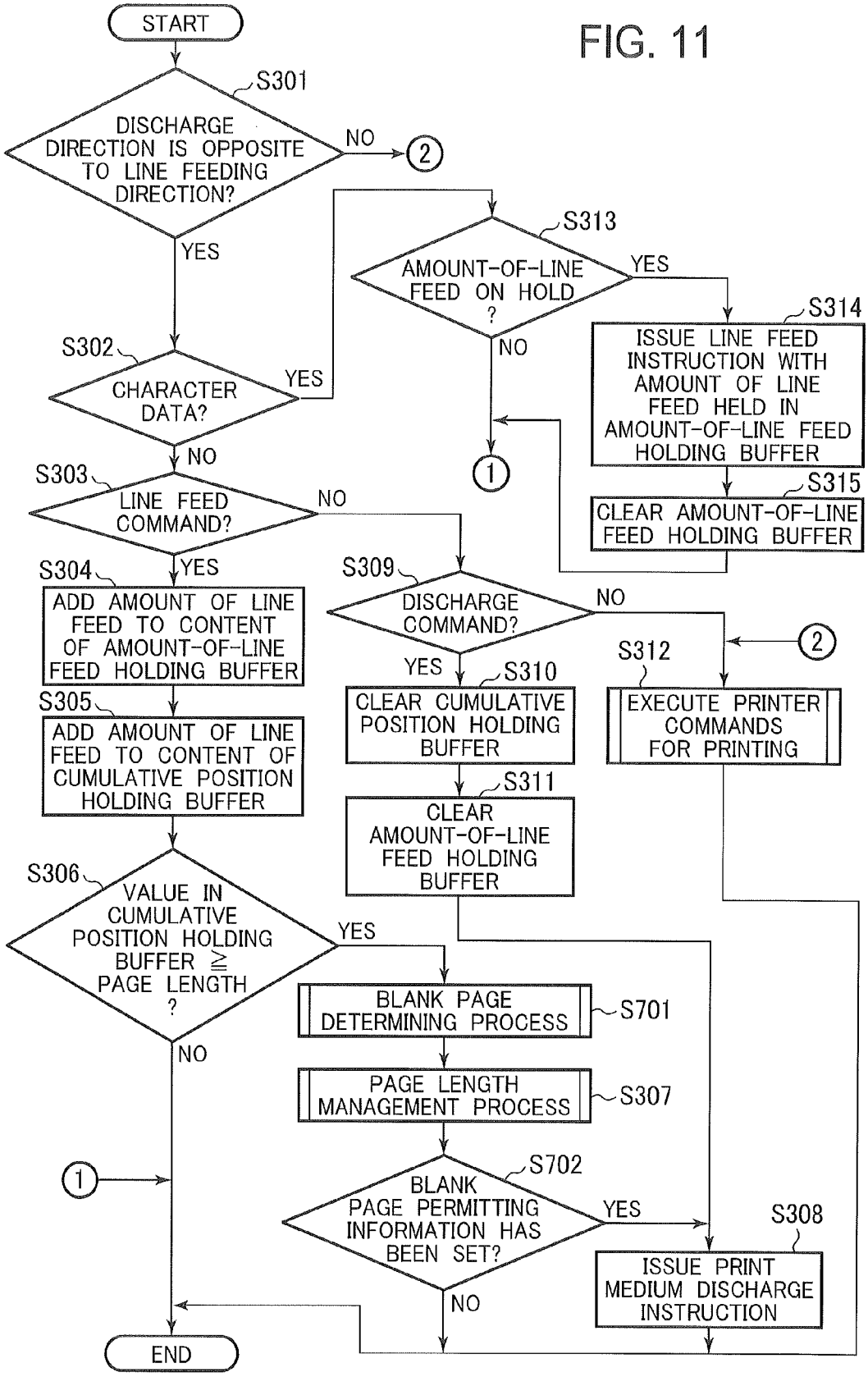
FIG. 11
START
S301
DISCHARGE DIRECTION IS OPPOSITE TO LINE FEEDING DIRECTION?
NO
2
YES
S302
CHARACTER DATA?
YES
NO
S303
LINE FEED COMMAND?
NO
YES
S304
ADD AMOUNT OF LINE FEED TO CONTENT OF AMOUNT-OF-LINE FEED HOLDING BUFFER
S305
ADD AMOUNT OF LINE FEED TO CONTENT OF CUMULATIVE POSITION HOLDING BUFFER
S306
VALUE IN CUMULATIVE POSITION HOLDING BUFFER ≧ PAGE LENGTH ?
YES
NO
1
END
S313
AMOUNT-OF-LINE FEED ON HOLD ?
YES
NO
1
S314
ISSUE LINE FEED INSTRUCTION WITH AMOUNT OF LINE FEED HELD IN AMOUNT-OF-LINE FEED HOLDING BUFFER
S315
CLEAR AMOUNT-OF-LINE FEED HOLDING BUFFER
S309
DISCHARGE COMMAND?
NO
YES
S310
CLEAR CUMULATIVE POSITION HOLDING BUFFER
S311
CLEAR AMOUNT-OF-LINE FEED HOLDING BUFFER
2
S312
EXECUTE PRINTER COMMANDS FOR PRINTING
BLANK PAGE DETERMINING PROCESS
S701
PAGE LENGTH MANAGEMENT PROCESS
S307
S702
BLANK PAGE PERMITTING INFORMATION HAS BEEN SET?
YES
NO
S308
ISSUE PRINT MEDIUM DISCHARGE INSTRUCTION

SEQUENCE OF RECEIVED DATA

| |
|---|
| PRINT DATA #1 |
| LINE FEED COMMAND #1 |
| LINE FEED COMMAND #2 |
| PRINT DATA #2 |
| LINE FEED COMMAND #3 |
| LINE FEED COMMAND #4 |
| LINE FEED COMMAND #5 |
| LINE FEED COMMAND #6 |
| LINE FEED COMMAND #7 |
| DISCHARGE COMMAND |

IMAGE FORMING APPARATUS AND METHOD FOR DISCHARGING A MEDIUM

BACKGROUND OF THE INVENTION

1. Field of the Invention

The present invention relates to an image forming apparatus capable of discharging a medium in a backward direction opposite to a forward direction in which the medium fed into the image forming apparatus, and a method of discharging a medium in a backward direction opposite to a forward direction in which the medium is fed into an image forming apparatus.

2. Description of the Related Art

Japanese Patent Publication No. H04-152164 discloses a printer that discharges a medium in a backward direction opposite to a forward direction in which the medium fed into the image forming apparatus. This printer receives print data and printer control commands including linefeed commands and a paper discharge command from a host personal computer. The printer then performs a printing operation and a paper transporting operation on a line-by-line basis in accordance with the print data and printer control commands.

If the print data for a page has a line feed command at the end of the print data, the line feed command is executed so that the medium is advanced forward by one line. A medium discharging operation is then performed to discharge the medium in a discharging direction opposite to the direction in which the paper is advanced forward by the line feed command. This implies that discharging the paper takes longer than necessary.

The present invention was made in view of the aforementioned drawbacks.

SUMMARY OF THE INVENTION

An object of the invention is to provide an image forming apparatus and a method of discharging a medium that can minimize the time required for discharging the printed paper.

An image forming apparatus can minimize the time required for discharging the printed paper. A memory that stores discharge direction information indicative of a discharge direction in which a print medium is discharged, page length information about the page length of the print medium, and the position of a line on the print medium relative to a leading end of the print medium if a line feed operation is performed. A receiving section is configured to store printer control data and character data received from an external apparatus. The printer control data includes line feed commands. A position detector outputs a detection signal indicative of a position of the print medium in the image forming apparatus. An image forming section is configured to perform printing on the print medium while transporting the print medium. A controller is configured to parse the character data and the printer control data, and then control the image forming section so that the image forming section feeds a page of the print medium to a print start position in accordance with the detection signal, and then prints the character data on the print medium in accordance with the parsed character data. The controller includes a line-feed command parser. When the discharge direction information indicates a discharge direction opposite to a line feed direction in which the page of print medium is advanced by the line feed operation, if the parsed printer control data is a line feed command, the line-feed command parser adds the amount of line feed specified by the line feed command to the position on the print medium held in the memory. If the position on the print medium after addition is within the page length, then the line-feed command parser places the added result on hold.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given byway of illustration only, and thus are not limiting the present invention, and wherein:

FIG. 11 is a flowchart illustrating a pertinent portion of a line-feed command parser;

DETAILED DESCRIPTION OF THE INVENTION

Figure 1A:
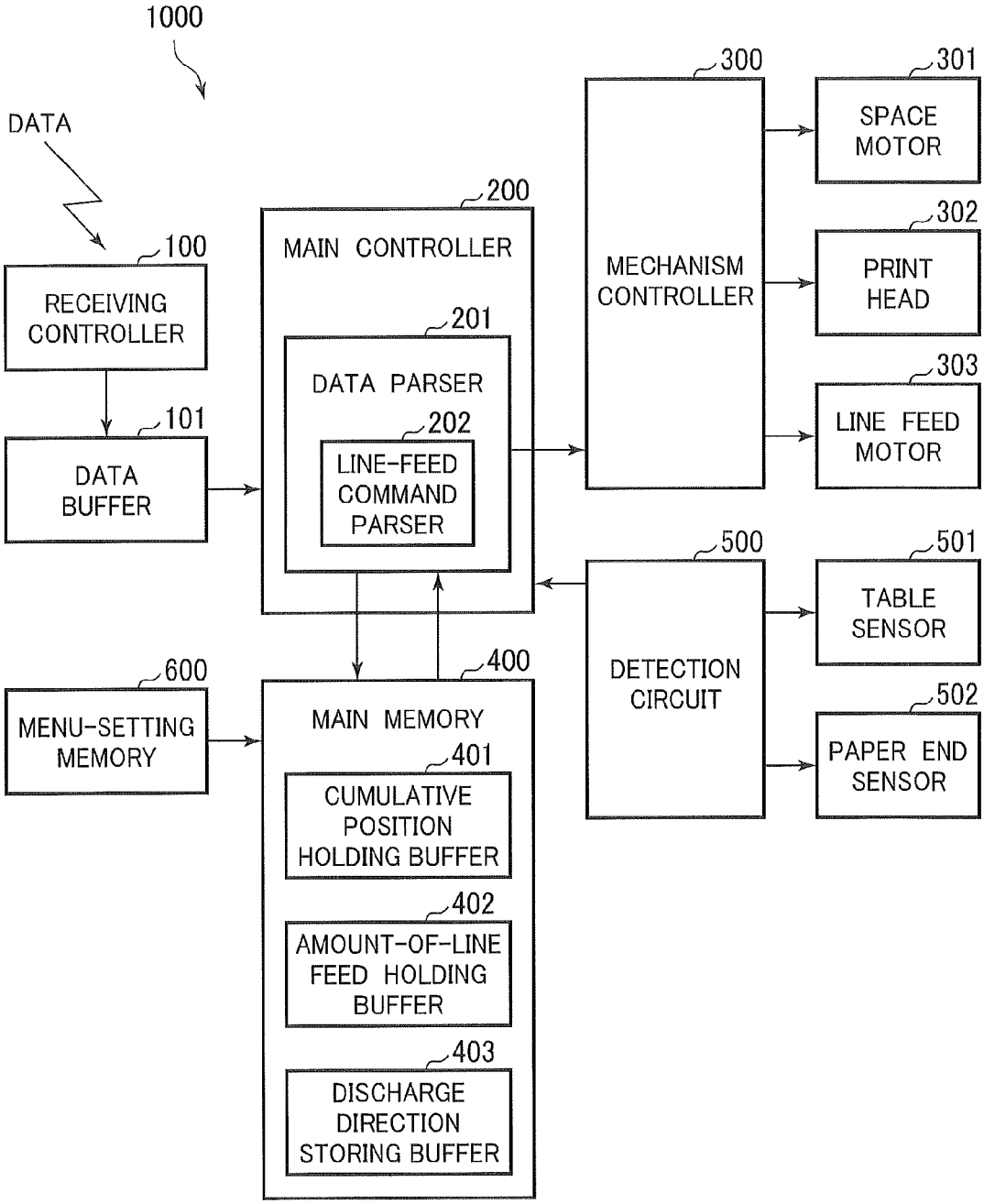
FIG. 1A is a block diagram of the printer according to the invention.

Embodiments of the invention will be described in detail with reference to the accompanying drawings in which like elements are indicated by like reference characters. The drawings are exemplary only, and should not be construed as limiting the invention. Like elements indicated by like reference characters are not described in duplicate.

First Embodiment

{Printer}

The printer according to a first embodiment performs a print medium discharging operation immediately after having printed the final line of the print data in a page regardless of whether the print medium has a remaining available printable area.

{Configuration of Printer}

The configuration of a printer 1000 will be described with reference to FIGS. 1A-1B. FIG. 1A is a block diagram of the printer 1000.

The printer 1000 is a horizontal feed serial printer in which printing is performed on the print medium on a line-by-line basis in accordance with print data under control of printer control commands, which include line feed commands received from a host personal computer (PC, not shown). The printer 1000 includes a receiving controller 100, a data buffer 101 for temporarily storing the received data, a main controller 200, a mechanism controller 300, a space motor 301, a print head 302, a line feed motor 303, a main memory 400, a detection circuit 500, a table sensor 501, a paper end sensor 502, and a menu-setting memory 600.

The receiving controller 100, main controller 200, mechanism controller 300, and detection circuit 500 are implemented in programs executed by a central processing unit (CPU) and exclusive hardware circuits. The data buffer 101 and the main memory 400 are implemented with memory devices including a random access memory (RAM), a read only memory (ROM) and a hard disk drive (HDD). The menu-setting memory 600 takes the form of, for example, a flash ROM.

A feed roller 503 (FIG. 1B) feeds paper as a print medium from the front side of the printer 1000 in a forward direction to an area between a print head 302 and a platen 505. After the print head 302 has printed on the paper, the paper is discharged (1) in the forward direction toward the rear side of the printer 1000, or (2) in a backward direction toward the front side of the printer 1000. The menu setting memory 600 stores information about the direction in which the printed paper is discharged. The user selects one of the print medium discharging directions via a menu screen (not shown) of the printer 1000. Alternatively, a printer control command representative of a discharging direction may be received from the host PC (not shown).

{Menu Setting Memory}

The menu setting memory 600 stores a variety of items of setting information including the information about the print medium discharging direction.

{Main Memory}

The main memory 400 includes a cumulative position holding buffer 401, an amount-of-line feed holding buffer 402, and a discharge direction storing buffer 403. The cumulative position holding buffer 401 stores the position of a current line printed on the print medium relative to the leading end of the print medium. When the print medium is fed to a print start position, which will be described later, the cumulative position holding buffer 401 initially holds the start position as the position of the current line. The amount-of-line feed holding buffer 402 holds information about the amount of line feed which would be a total amount of line feed before line feeding is executed. The discharge direction storing buffer 403 holds the discharge direction information indicative of the discharge direction of the paper, specified via the menu screen by the user or by a printer control command.

{Receiving Controller and Data Buffer}

The receiving controller 100 operates under control of the main controller 200, and receives the print data and printer control commands from the host PC (not shown). The data buffer 101 stores the print data and printer control commands received through the receiving controller 100. In this specification, the term print data may cover not only image data or character data that is actually printed on paper but also commands including spacing. The printer control commands include a feed command, a print medium discharge command for discharging the paper from the printer 1000, an amount-of-line feed setting command for setting the amount of line feed, N, and a discharge direction setting command for selecting the print medium discharging direction.

{Print Head, Space Motor, Line Feed Motor}

Figure 1B:
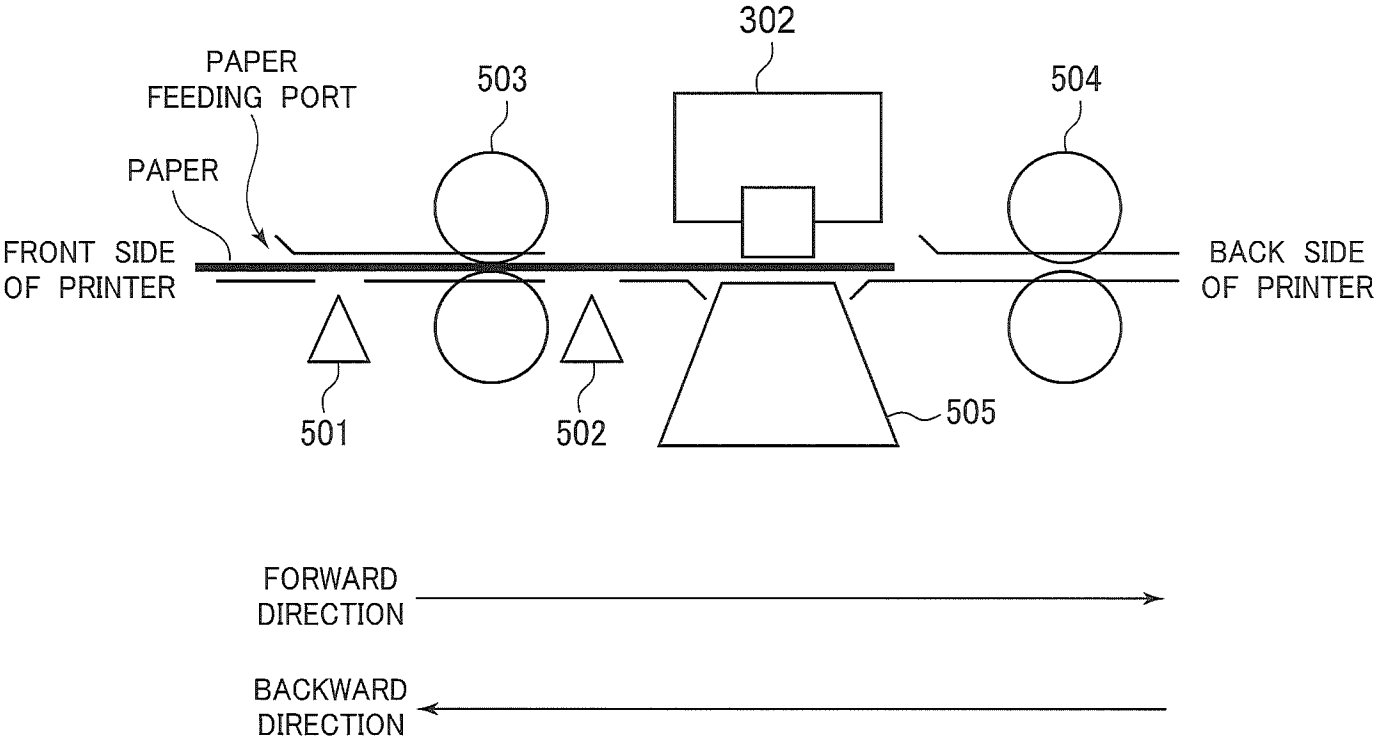
FIG. 1B is a diagrammatic cross-sectional view illustrating a pertinent portion of the printer.

FIG. 1B is a diagrammatic cross-sectional view illustrating a pertinent portion of the printer 1000. The print head 302 has a plurality of dot pins for printing and is movable across the width of the paper. The space motor 301 drives the print head 302 to move back and forth across the width of the paper or in a main scanning direction, so that the print head 302 prints a dot pattern on the paper. A feed roller 503 is disposed upstream of the print head 302 and a feed roller 504 is disposed downstream of the print head 302. The line feed motor 303 drives the feed rollers 503 and 504 to rotate in their forward direction during the line feed operation, so that the feed rollers 503 and 504 feed the paper in the forward direction perpendicular to the main scanning direction. The line feed motor 303 drives the feed rollers 503 and 504 to rotate in their backward direction during the print medium discharging operation, so that the feed rollers 503 and 504 feed the paper in the backward direction opposite to the forward direction.

{Mechanism Controller}

Upon reception of a print instruction from the main controller 200, the mechanism controller 300 drives the space motor 301 to move the print head 302 back and forth across the width of the paper, i.e., in the main scanning direction, so that the print head 302 prints a dot pattern on the paper when the print head 302 moves in the forward direction and when the print head 302 moves in the backward direction.

Upon reception of a line feed instruction specifying an amount-of-line feed stored in the amount-of-line feed holding buffer 402, the mechanism controller 300 drives the line feed motor 303 to rotate at different speeds in accordance with the specified amount of line feed. The line feed motor 303 rotates at a higher speed when the amount of line feed is large than when the amount of line feed is small. The feed rollers 503 and 504 rotate by a specified amount-of-rotation in their forward direction, thereby causing the paper to advance by a specified distance.

Upon reception of a print medium discharge instruction having information about the discharging direction stored in the discharge direction storing buffer 403, the mechanism controller 300 drives the line feed motor 303 to rotate in a direction specified by the information about the discharging direction. Thus, the feed rollers 503 and 504 rotate either in the forward direction to transport the paper in the forward direction or in the backward direction until the paper is discharged completely to the outside of the printer 1000. When the paper may be discharged in the forward direction or in the backward direction.

{Table Sensor, Paper End Sensor}

The table sensor 501 (FIG. 1B) is located upstream of the feed roller 503 with respect to the forward direction, and detects the paper. The detection signal generated by the table sensor 501 is sent to the main controller 200, and is used to determine the timing at which a print medium feeding process is performed. The paper end sensor 502 is located between the feed roller 503 (FIG. 1B) and the print head 302, and detects presence or absence of the paper. The detection signal of the paper end sensor 502 is used in a later described cueing operation in the print medium feeding process or in the discharging operation during a later described line feed command parsing process.

{Detection Circuit}

The detection circuit 500 receives the detection signals from the table sensor 501 and the paper end sensor 502, and sends the detection signals to the main controller 200.

{Main Controller}

When the table sensor 501 detects that the paper has been positioned at the print medium feeding port, the main controller 200 starts feeding the paper to a cueing position. Specifically, the main controller 200 drives the mechanism controller 300 to cause the line feed motor 303 to rotate the feed roller 503, so that the paper is transported in the forward direction. The main controller 200 monitors the detection signal of the paper end sensor 502, and detects that the paper end sensor 502 has detected the leading end of the paper ("presence of paper"). Once the paper end sensor 502 has detected the leading end of the paper, the main controller 200 causes the feed roller 503 to further advance the paper by a predetermined period of time, thereby placing the paper in the cueing position.

The main controller 200 receives the print data and printer control commands from the host PC (not shown) via the receiving controller 100, and stores the received print data into the data buffer 101. The main controller 200 includes a data parser 201 that includes a line-feed command parser 202. The data parser 201 reads the received print data from the data buffer 101, and the line-feed command parser 202 parses the commands, thereby performing a variety of processes on the character data in accordance with the types of commands. The details of the data parser 201 and the line-feed command parser 202 will be described later along with the operation of the printer 1000, and therefore only a brief description of the data parser 201 and the line-feed command parser 202 are given below.

{Data Parser}

The data parser 201 parses the print data and the printer control commands stored in the data buffer 101. The data parser 201 includes the line-feed command parser 202 as shown in FIG. 1A.

{Line-Feed Command Parser}

The line-feed command parser 202 reads the received print data from the data buffer 101 on a byte-by-byte basis, and parses the printer control commands, thereby processing the print data on a byte-by-byte basis in accordance with a corresponding command. If a byte read from the data buffer 101 is a line feed command, then it is determined that the bytes before the line feed command are the data for one line that should be printed on the print medium. One of the features of the invention is that the line-feed command parser 202 places the line feed commands on hold. The line-feed command parser 202 will be described in more detail along with the printer 1000.

{Operation of Printer}

A description will be given below of the printer 1000 according to the first embodiment. The cueing position is the distance between the leading end of the paper and a print start position on the paper where printing is actually initiated on the page, and is selected through the menu screen. The cueing position is selected to be, for example, 1/12 in., 2/12 in., 3/12 in., or 4/12 in. Assume that the print medium discharging direction and cueing position have been set previously through the menu screen (not shown). Assume that the menu screen shows the cueing position of 3/12 in. by default. Since the printer 1000 has a resolution of 1/360 in. in the auxiliary direction, the actual cueing position is a distance equivalent to 90 dots×1/360=90/360 in. away from the leading end of the print medium paper.

{Flow of Overall Process in Printer}

Figure 2:
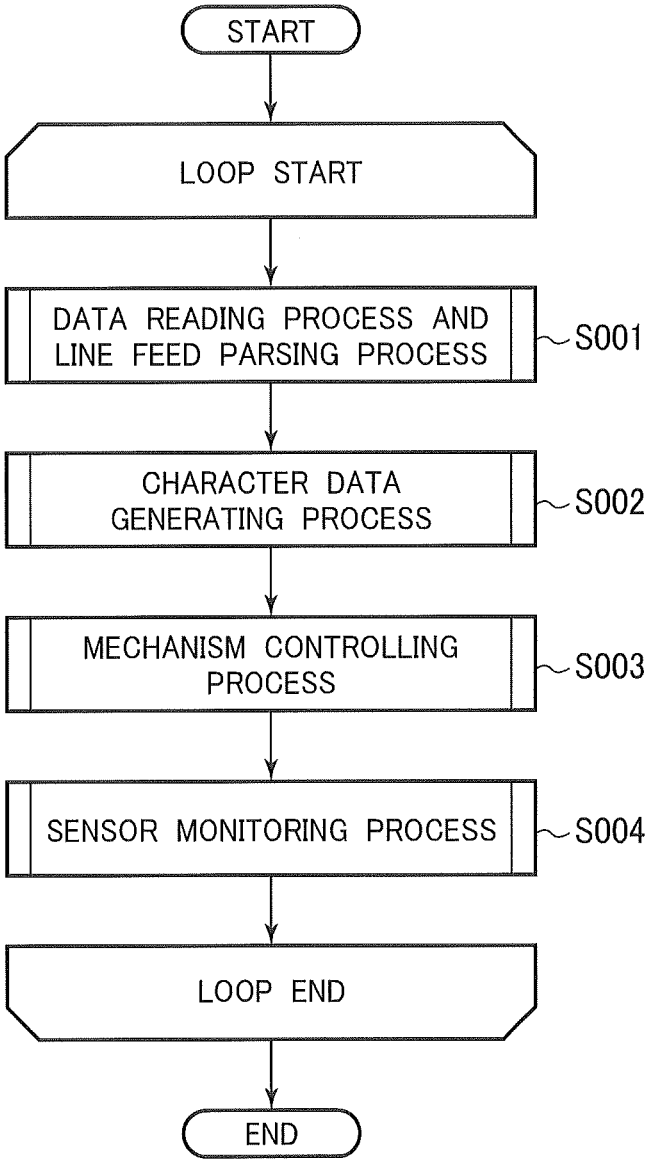
FIG. 2 is a flowchart illustrating the overall process.

FIG. 2 is a flowchart illustrating the do loop for the overall process. The flow of the overall process of the printer 1000 will be described with reference to FIG. 2. The main controller 200 and mechanism controller 300 are implemented during execution of the overall process in the printer 1000. The do loop is running at all times while the image forming apparatus is online. Steps S001-S004 in the do loop shown in FIG. 2 are executed for each byte read from the data buffer 101.

Figure 4:
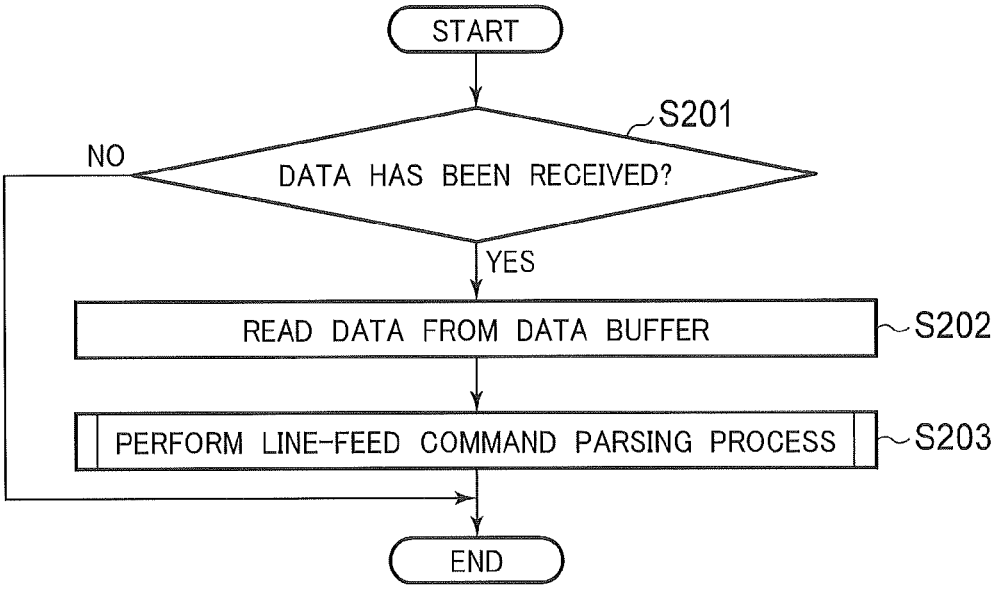
FIG. 4 is a flowchart illustrating received data reading process performed in the printer.
Figure 5:
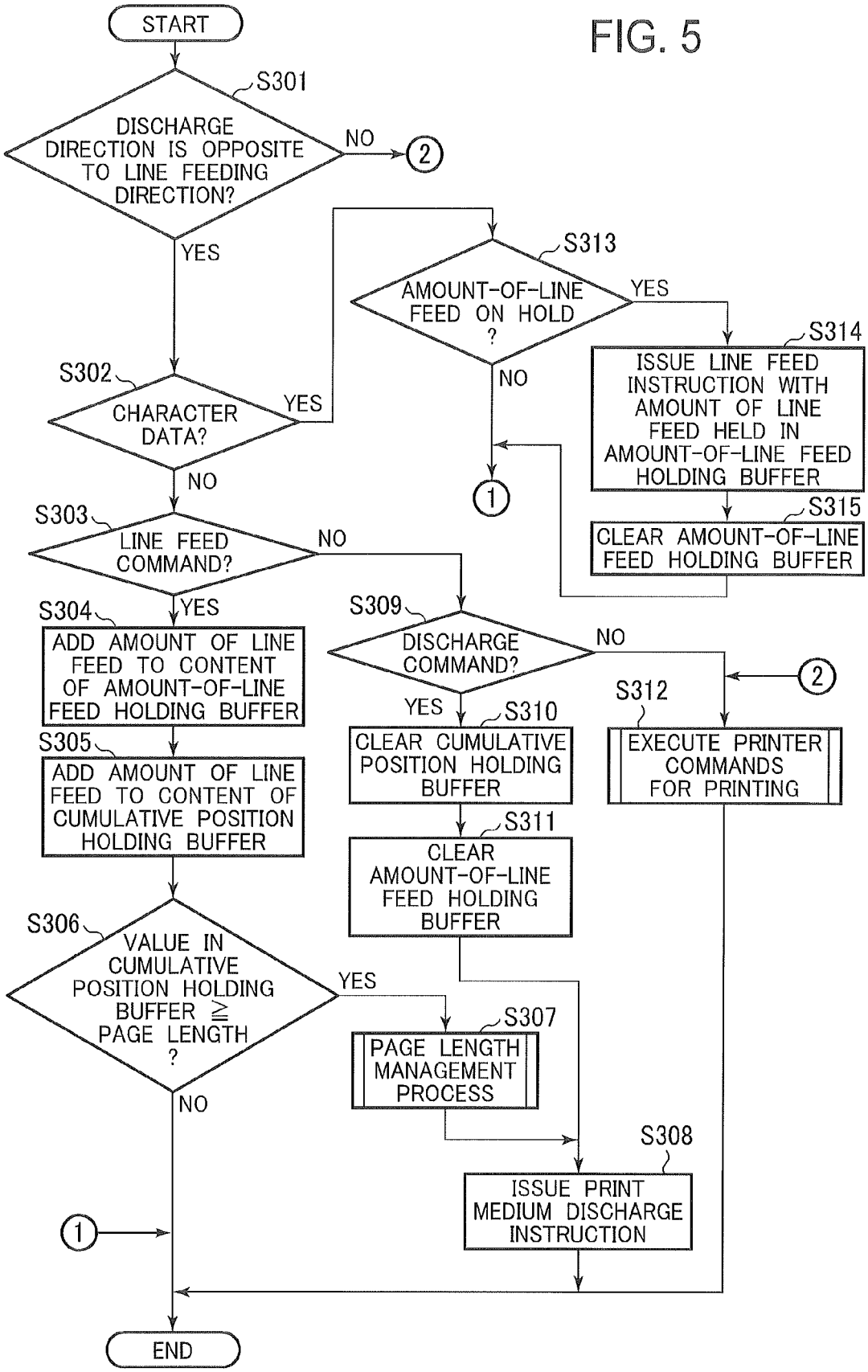
FIG. 5 is a flowchart illustrating a line-feed command parsing process.

At S001, a data reading process and a line feed parsing process are performed in which the received data, i.e., a byte is read from the data buffer 101 (FIG. 4) and is then parsed (FIG. 5). At S002, a dot pattern generating process is performed in which the dot pattern for the parsed character data is generated, if the received data, i.e., byte read from the data buffer 101 is character data.

Figure 3:
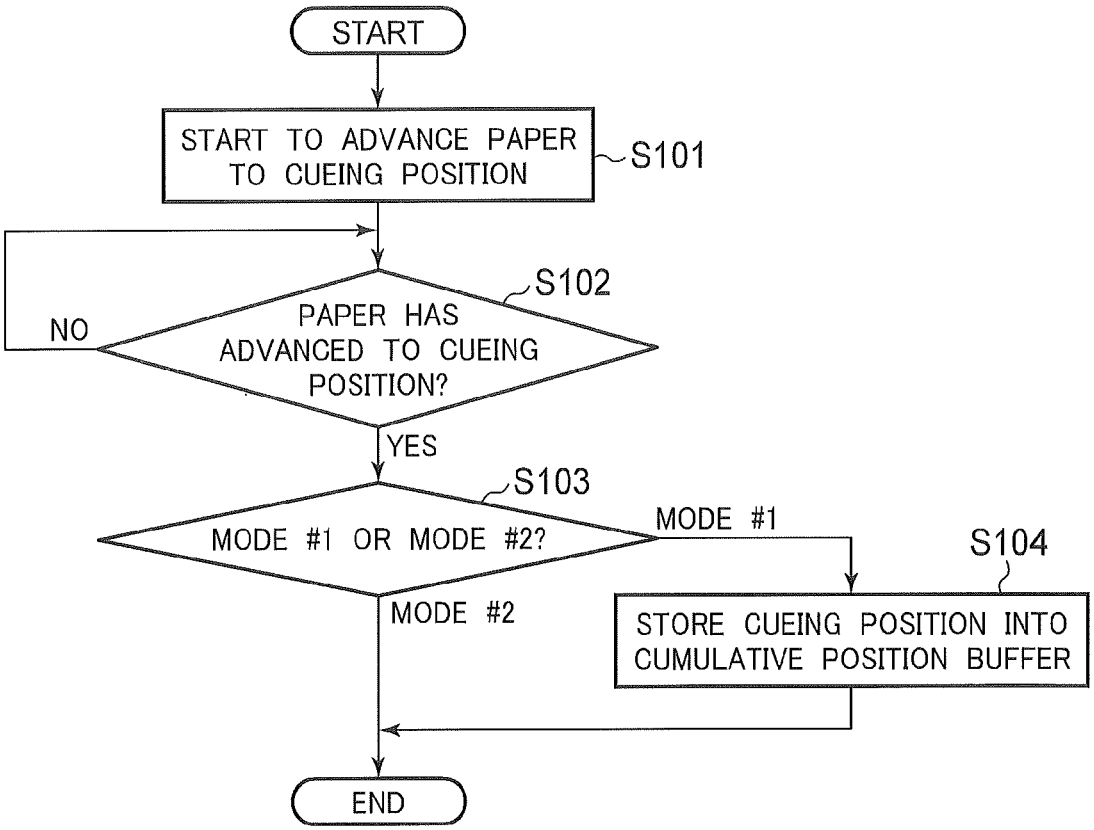
FIG. 3 is a flowchart illustrating a paper feeding process performed in the printer according to a first embodiment.

At S003, a mechanism controlling process is performed in which the space motor 301 is driven in rotation for causing the print head 302 to print the dot pattern for the character data on the paper, and the line feed motor 303 is driven in rotation for causing the feed rollers 503 and 504 to line-feed the paper or discharge the paper, thereby printing the dot pattern for the character data from the data buffer 101. The print medium feeding process shown in FIG. 3 is performed at 5003. At 5004, a sensor monitoring process is continually performed in which the detection circuit 500 detects the outputs of the variety of sensors. Steps S001-S004 are carried out in a cyclic manner for the received data until the data for all pages in the data buffer 101 has been printed. The overall operation will be described below.

{Paper Feeding Process}

FIG. 3 is a flowchart illustrating the print medium feeding process performed in the printer 100 according to the first embodiment. The print medium feeding process includes advancing the paper to the cueing position and initializing the working area of the memory necessary for controlling the involved mechanisms.

Once the table sensor 501 detects that the paper has been positioned at the print medium feeding port, the main controller 200 starts to advance the paper to the cueing position (S101). Specifically, at S101, the main controller 200 sends an instruction to the mechanism controller 300 which in turn drives the line feed motor 303 to rotate the feed roller 503 to advance the paper in the forward direction.

At S102, the main controller 200 makes a decision to determine whether the paper has advanced to the cueing position. Specifically, the main controller 200 drives the detection circuit 500 to detect that the paper end sensor 502 has outputted a detection signal indicative of "presence of paper" following a detection signal indicative of "absence of paper." The main controller 200 then causes the paper to advance in the forward direction for a predetermined period of time shortly after the "presence of paper," so that the paper arrives at the cueing position.

At S103, the line feed command parser 202 of the data parser 201 makes a decision to determine whether the page length managing method preset in the printer 1000 is mode #1 or mode #2. If the page length managing method is in mode #1, then the program proceeds to step 104. If the page length managing method is in mode #2, then the program ends. The page length managing mode will be described later in more detail.

If the page length managing method is in mode #1 at S103, the main controller 200 initializes the working area of the memory necessary for controlling the printer 1000. Specifically, at S104, the main controller 200 stores the cueing position, which is selected through the menu screen, into a cumulative position holding buffer 401 that holds a cumulative distance from the leading end of the paper. If the page length managing method is in mode #1, a value "90" is set to the cumulative position holding buffer 401. In mode #1, the cueing position is defined as the distance from the leading end of the paper, and therefore the same value as the cueing position is stored into the cumulative position holding buffer 401 shortly after completion of print medium feeding process. In mode #2, the distance from the cueing position is defined as a reference in determining the page length which is the distance between the leading end of a page of print medium and the trailing end of the page. Therefore, a value "0" is stored into the cumulative position holding buffer 401 shortly after completion of the print medium feeding process. After performing the print medium feeding process, the program proceeds to S004 (FIG. 2).

{Received Data Reading Process}

FIG. 4 is a flowchart illustrating the received data reading process performed in the printer 1000. The received data reading process will be described with reference to FIG. 4.

Upon completion of the print medium feeding process, at S201, the data parser 201 of the main controller 200 makes a decision to determine whether the print data has been received in the data buffer 101. If the print data has been received (YES at S201), the program proceeds to S202. If the print data has not been received (NO at S201), the received data reading process ends.

If the answer is YES at S201, the data parser 201 reads the received data on a byte-by-byte basis from the data buffer 101 at S202. The line-feed command parsing process, which will be described in detail, is then performed at S203. Upon completion of the line-feed command parsing process, the received data reading process ends. After the received data reading process ends, the program proceeds to the line-feed command parsing process shown in FIG. 5.

{Line-Feed Command Parsing Process}

FIG. 5 is a flowchart illustrating the line feed command parsing process. The line feed command parsing process will be described with reference to FIG. 5.

At S301, the main controller 200 first refers to the discharge direction information stored in the discharge direction storing buffer 403 in the main memory 400, and then makes a decision to determine whether the discharge direction is opposite to the line feed direction, i.e., forward direction. If the discharge direction is not opposite to the line feed direction (NO at S301), the program jumps to S312 where appropriate commands including the line feed command and print medium discharge command are executed. If the discharge direction is opposite to the line feed direction (YES at S301), the program proceeds through S302, 303, and 309 to S312 where appropriate commands except for the line feed command and print medium discharge command are executed.

If the answer is NO at S301, the line feed command parser 202 makes a decision to determine whether the received data is the character data (S302). If the received data is not print data (NO at S302), the program proceeds to S303. If the received data is character data (YES at S302), then the program proceeds to S313.

If the answer is YES at S302, the line-feed command parser 202 makes a decision to determine whether the received data is a line feed command (S303). If the received data is a line feed command (YES at S303), then the program proceeds to S304. If the received data is not a line feed command (NO at S303), then the program proceeds to S309.

If the answer is YES (i.e., the received data is a line feed command) at S303, the line-feed command parser 202 adds an amount of line feed specified by the line feed command to the content of the amount-of-line feed holding buffer 402 in the main memory 400 (S304), and then adds the amount of line feed specified by the line feed command to the content of the cumulative position holding buffer 401 (S305).

The line feed command specifies the amount of line feed in terms of the number of line feeds or an absolute distance. If the amount of line feed is to be specified in terms of the number of line feed commands, the amount of line feed for each line feed command is set either by the user through the menu screen or by an amount-of-line feed setting command to set an amount of line feed. Many types of printers have an amount of line feed equal to six lines per inch (6LPI) by default, i.e., the line feed operation may be performed six times per inch. The printer 1000 has a resolution of $1/360$ in., and therefore the amount of each line feed is a distance equivalent to 60 dots, i.e., $60/360$ in. per line feed. However, if the command to set an amount of line feed specifies an amount of line feed, N, for each line feed, the resultant amount of line feed is N/360.

At S306, the line-feed command parser 202 makes a decision to determine whether the value in the cumulative position holding buffer 401 exceeds the page length of the actual page length of the paper, i.e., whether the sum of the position on the print medium and the amount of line feed specified by the line feed command is not within the current page. The page length may be set through the menu screen (not shown) of the printer 1000. In some cases, the host PC may send a page length setting command to the printer 1000 prior to transmission of the print data. For example, if the page length is set to 11 inches, the actual page length is equal to 3960 dots× $1/360=3960/360$ in. since the printer 1000 has a resolution of $1/360$ in.

If the answer is NO at S306, i.e., the content of the cumulative position holding buffer 401 is smaller than the page length, the line-feed command parser 202 is terminated while the amount of line feed remains placed on hold. In other words, the line feed operation is not performed at this point of time, and the program proceeds to the parsing of the next line. If the answer is YES at S306 or the content of the cumulative position holding buffer 401 is equal to or larger than the page length, a page length managing process is performed (S307). The page length managing process will be described later in detail. The program then proceeds to S308.

At S308, the main controller 200 issues a print medium discharge instruction to the mechanism controller 300, which in turn performs a print medium discharge operation in accordance with the discharge direction information stored in the discharge direction storing buffer 403 of the main memory 400, so that the paper is discharged in the backward direction (S003 in FIG. 2). This completes the line-feed command parsing process.

When the paper is to be discharged in the backward direction, the main controller 200 monitors the output of the paper end sensor 502 while the paper is being discharged in the backward direction and determines the timing at which the print medium discharge process should be stopped. Specifically, when the detection signal of the paper end sensor 502 indicates "presence of paper," if the print medium discharge process is performed to discharge the paper in the backward direction, the output of the paper end sensor 502 changes from "presence of paper" to "absence of paper." The main controller 200 terminates the print medium discharge process a predetermined time after the detection of the "absence of paper." On the other hand, when the detection signal of the paper end sensor 502 indicates "absence of paper," if the print medium discharge process is performed to discharge the paper in the backward direction, the output of the paper end sensor 502 changes from "absence of paper" to "presence of paper," and then back to "absence of paper." The main controller 200 terminates the print medium discharge process a predetermined time after the detection of the second "absence of paper."

If the answer is NO at S303, i.e., the byte read from the data buffer 101 is not a line feed command, the line-feed command parser 202 makes a decision to determine whether the received data is a print medium discharge command (S309). If the received data is a print medium discharge command (YES at S309), then the program proceeds to S310. If the received data is not a print medium discharge command (NO at S309), then the program proceeds to S312.

If the answer is YES at S309, i.e., the received data is a print medium discharge command, the line-feed command parser 202 then clears the cumulative position holding buffer 401 (S310). The line-feed command parser 202 clears the amount-of-line feed holding buffer 402 (S311) since the line feed need not be performed. The main controller 200 then issues a print medium discharge command to the mechanism controller 300 (S308), completing the line-feed command parsing process.

If the answer is NO at S301, the data parser 201 of the main controller 200 executes conventional printer commands for printing (S312), completing the line-feed command parsing process. If the answer is NO at S309, the data parser 201 of the main controller 200 executes printer commands for printing except for the line feed command and print medium discharge command (S312), completing the line-feed command parsing process.

If the answer is YES at S302, i.e., the received data is character data, the line-feed command parser 202 refers to the amount-of-line feed holding buffer 402 to check whether the amount-of-line feed holding buffer 402 holds an amount of line feed that has been placed on hold (S313). If the amount-of-line feed holding buffer 402 holds an amount of line feed placed on hold, the program proceeds to S314. If the amount-of-line feed holding buffer 402 does not hold an amount of line feed placed on hold, the program ends.

If the answer is YES at S313, i.e., the amount-of-line feed holding buffer 402 holds an amount of line feed placed on hold, the amount of the line feed that has been placed on hold requires to be executed. Thus, at S314, the line-feed command parser 202 sends a line feed instruction to the mechanism controller 300 so that a line feed operation is actually performed with an amount of line feed held in the amount-of-line feed holding buffer 402, and then clears the amount-of-line feed holding buffer 402 (S315).

Following the line-feed command parsing process, the program proceeds to the dot pattern generating process (S002 in FIG. 2). In other words, if the amount-of-line feed holding buffer 402 does not hold an amount of line feed placed on hold, the dot pattern generating process is performed immediately. If the amount-of-line feed holding buffer 402 holds an amount of line feed placed on hold, the dot pattern generating process is performed only after completion of the line feed. The print data includes commands related to printing, for example, a spacing command that is executed prior to an actual printing operation of any character data. The dot pattern generated during the dot pattern generating process is printed with the print head 302, which is moved across the paper by the space motor 301 driven by the mechanism controller 300 (S003 in FIG. 2).

{Page Length Managing Process}

Figure 6A:
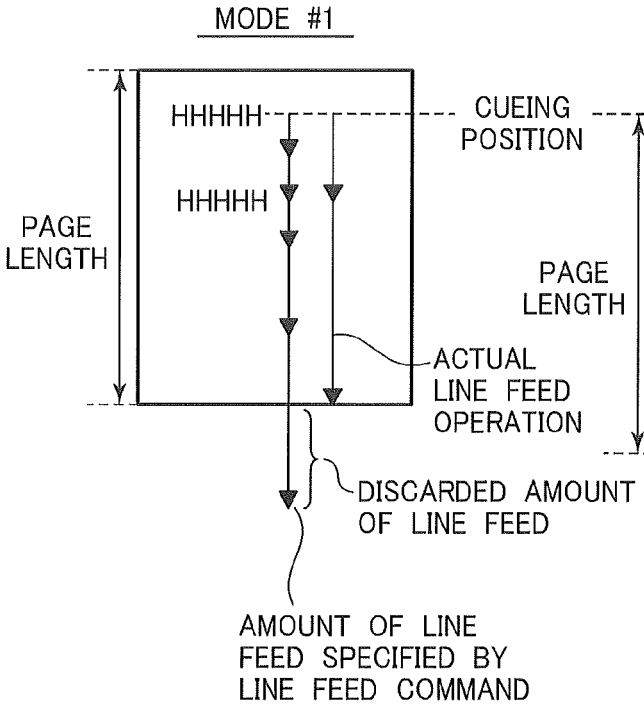
FIGS. 6A and 6B illustrate how a page length is managed.
Figure 6B:
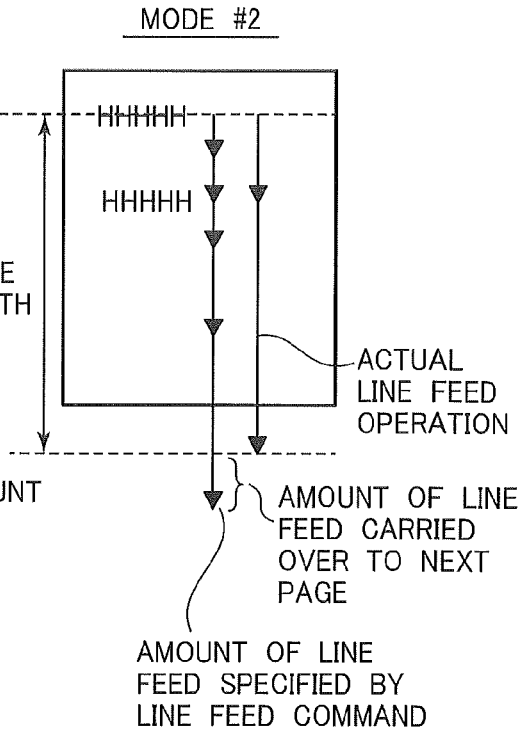

The operation of the page length managing process will be described with reference to FIGS. 6A-6B and 7. FIGS. 6A and 6B illustrate how the page length is managed. Arrows indicate the movement of the print head 302 relative to the print medium.

With reference to FIGS. 6A-6B, a description will be given of how the page length is managed. The printer 1000 manages the page length in two modes: mode #1 in which the page length is defined with reference to the leading end of the paper as shown in FIG. 6A and mode #2 in which the page length is defined with reference to the cueing position on the paper as shown in FIG. 6B. In other words, the mode #1 and the mode #2 differ in reference position. Mode #1 is used when data for a single sheet is printed on a single sheet. Mode #2 is used when the data for fanfold paper is printed on a plurality of single sheets, each portion of the data being printed on a corresponding single sheet. The user is allowed to switch between mode #1 and mode #2 via the menu screen of the printer 1000 according to his preference.

In mode #1, the paper is merely discharged when the cumulative amount of line feed exceeds the page length. In other words, the amount of line feed exceeding the page length is simply ignored and discarded. In mode #2, an amount of line feed exceeding the page length is carried over to the next page.

Figure 7:
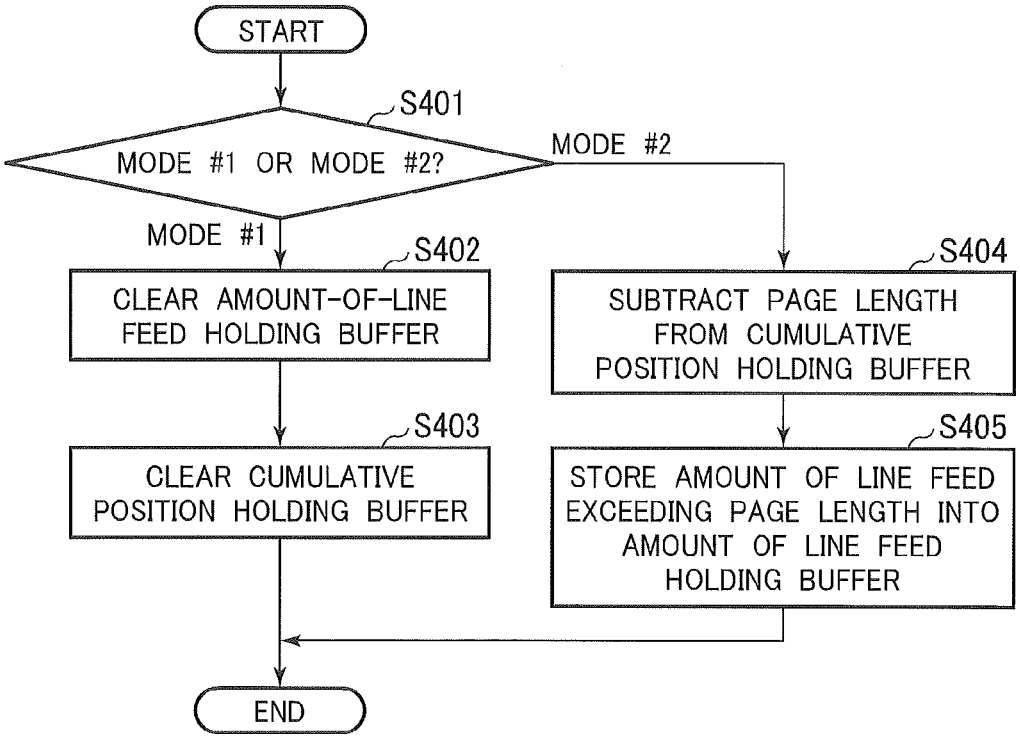
FIG. 7 is a flowchart illustrating a page length managing process performed in the printer.

FIG. 7 is a flowchart illustrating the page length managing process performed in the printer 1000. The page length managing process will be described with reference to FIG. 7. First, the line-feed command parser 202 of the data parser 201 makes a decision to determine whether the mode for managing the page length preset in the printer 1000 is mode #1 or mode #2 (S401). If mode #1 has been preset, the program proceeds to S402. If mode #2 has been preset, the program proceeds to S404.

If the answer is mode #1 at S401, the line-feed command parser 202 clears the amount-of-line feed holding buffer 402 since the amount of line feed exceeding the page length need not be carried over to the next page (S402), and subsequently clears the cumulative position holding buffer 401 (S403).

If the answer is mode #2 at S401, the amount of line feed exceeding the page length needs to be carried over to the next page. Therefore, the line-feed command parser 202 subtracts the page length from the value stored in the cumulative position holding buffer 401 (S404), and then stores the amount of line feed exceeding the page length into the amount-of-line feed holding buffer 402 (S405). The amount of line feed exceeding the page length is now a cumulative position for the next page and is executed on the next page. Following the page length managing process, the program proceeds to S308 (FIG. 5).

{Effects}

Figures 8A, 8B:
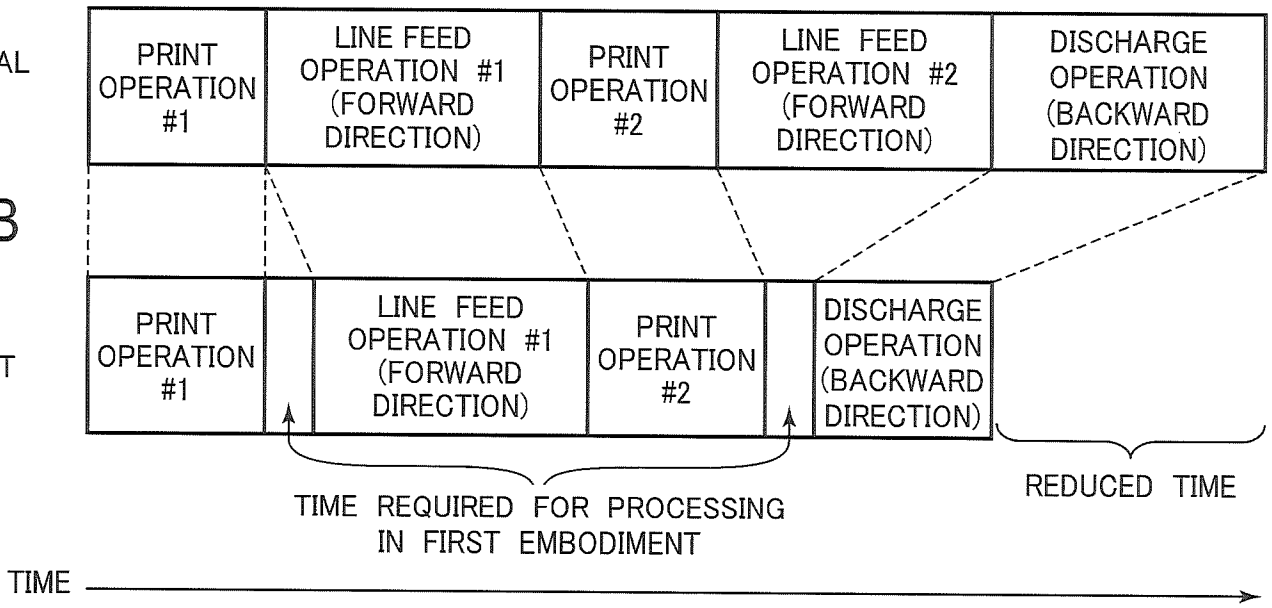
FIG. 8A CONVENTIONAL ART
FIGS. 8A-8B illustrate a cumulative amount of time required for the respective operations until paper is discharged.
Figure 9B:
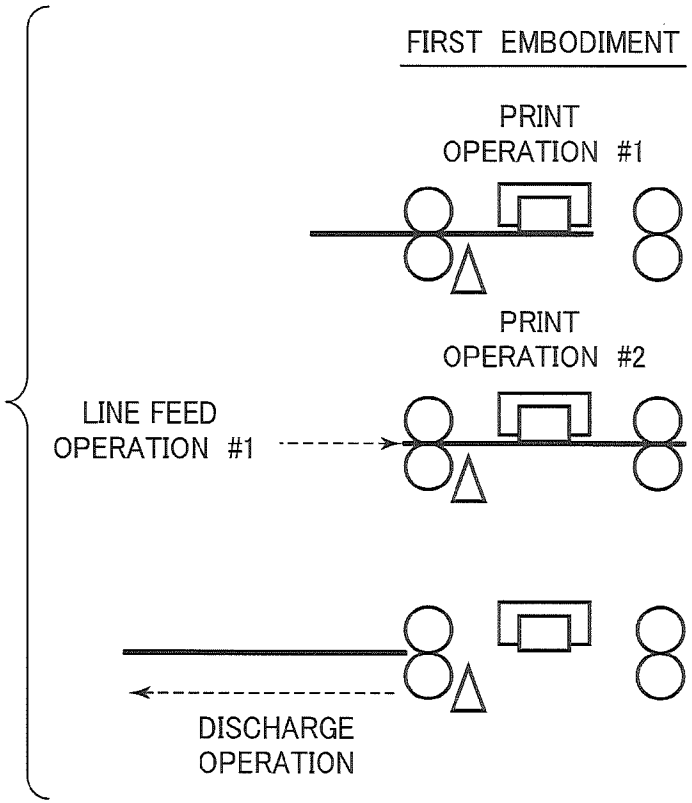
FIGS. 9A-9B illustrate the position of the paper relative to the print head and feed rollers during the respective operations until the paper is discharged.
Figure 9A:
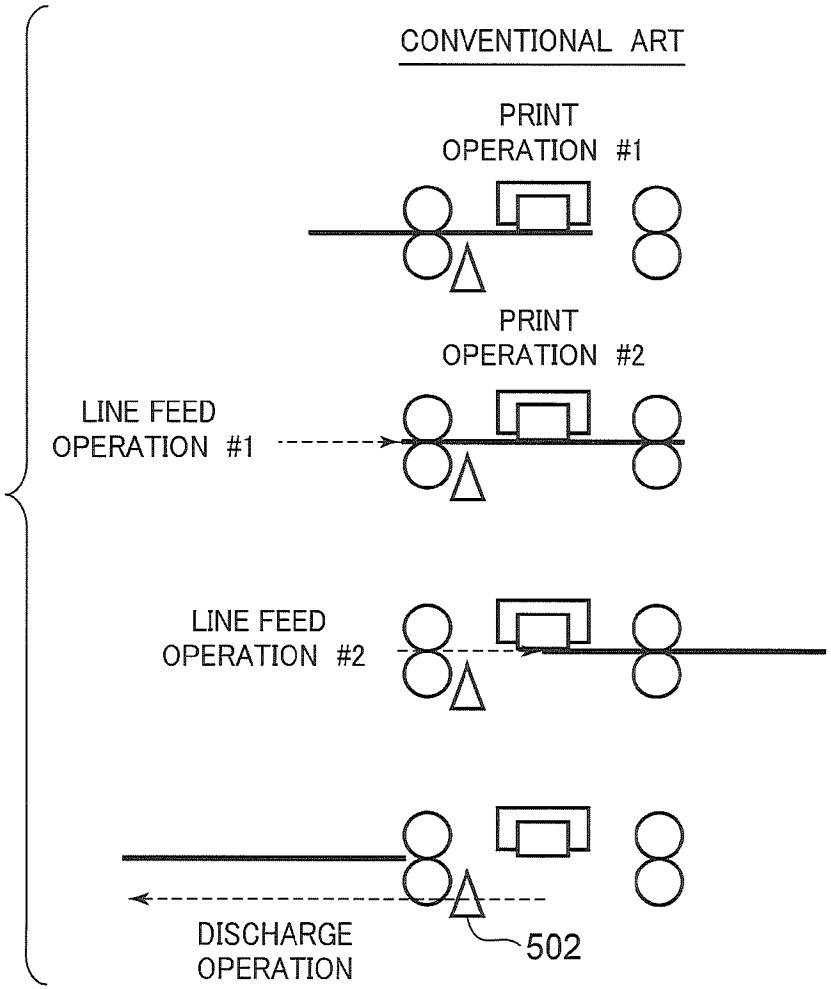

By comparing the first embodiment with the conventional art, the effects of the printer 1000 according to the first embodiment will be described with reference to FIGS. 8A-8B and 9A-9B. FIG. 8A-8B illustrate a cumulative amount of time required for the respective operations until the paper is discharged. FIGS. 9A and 9B illustrate the position of the paper relative to the print head 302 and feed rollers 503 and 504 during the respective operations until the paper has been discharged.

As is clear from FIGS. 8A-8B and 9A-9B, the printer 1000 does not perform a line feed operation #2 (FIG. 8A-8B) of the conventional art, and the time required for discharging the paper decreases correspondingly. Therefore, the time required for printing a job may be reduced by the time required for performing the line feed operation #2 and the shortened time required for discharging the paper.

FIGS. 8A-8B diagrammatically show the time required for the respective operations in the first embodiment and conventional printer. The first embodiment necessitates the time required for updating the contents of the cumulative position holding buffer 401, amount-of-line feed holding buffer 402, and the time required for making decisions, which are not required in the conventional printer. However, these times are much shorter than the time required for discharging the paper.

Once printing is started, the next byte may be parsed while the printing of the current character is being carried out. In other words, the first embodiment greatly reduces the total time including the time required for discharging the paper.

As described above, when the paper is discharged in a direction opposite to a line feed direction in which line feed operations are performed while printing the character data on the paper, the amount of line feed remains placed on hold until the printing operation of the parsed character data actually starts. In other words, the line feed operation is actually performed immediately before the subsequent parsed character data is printed on the paper. This prevents unnecessary line feed operations from being performed before discharging the paper, and therefore reduces the total time from receiving the print data to discharging the printed paper.

Second Embodiment

A second embodiment differs from the first embodiment in that a printer 1000*a* uses a blank page controller 203. The blank page controller 203 manages the outputting of a blank page even when the host PC has no special middleware or means that prevents the blank page from being outputted.

{Configuration}

Figure 10:
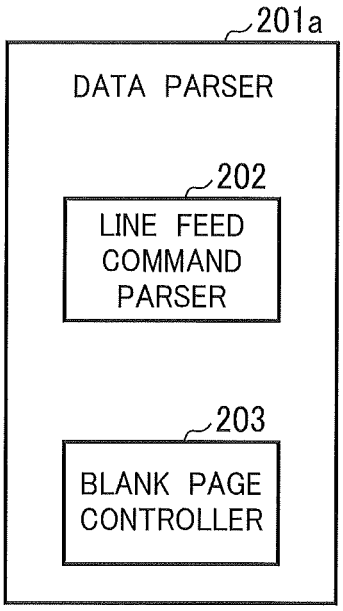
FIG. 10 illustrates functions of a data parser of the printer according to a second embodiment.

FIG. 10 illustrates functions of a data parser 201*a* of the printer 1000*a* according to the second embodiment. The configuration of the printer 1000*a* will be described with reference to FIG. 10. The data parser 201*a* differs from the data parser 201 according to the first embodiment in that the blank page controller 203 is added. The second embodiment will be described mainly in terms of the functions of the data parser 201*a* different from those of the data parser 201.

{Data Parser}

The data parser 201*a* includes a line-feed command parser 202 and the blank page controller 203. The blank page controller 203 drives a cumulative position holding buffer 401 (FIG. 1) and an amount-of-line feed holding buffer 402 (FIG. 1) to or not to output a blank page. The data parser 201*a* will be described later in more detail, {Operation of Printer}

The print medium feeding process shown in FIG. 3, the received data reading process in FIG. 4, and the page length managing process are also used in the second embodiment, and their description is omitted.

{Line-Feed Command Parsing Process}

FIG. 11 is a flowchart illustrating a pertinent portion of a line-feed command parsing process. The line-feed command parsing process according to the second embodiment (FIG. 1) differs from that according to the first embodiment (FIG. 5) in that S701 is added immediately before S307 and S702 is added immediately after S307. Steps similar to those in the first embodiment shown in FIG. 5 have been given the same reference numerals, and their description is omitted.

If the answer is YES at S306, i.e., the content of the cumulative position holding buffer 401 exceeds the page length, the blank page controller 203 performs the blank page determining process (S701), which will be described later in detail. The program then proceeds to S307.

Following S307, the blank page controller 203 makes a decision to determine at S702 whether blank page permitting information has been set as a result of execution of S701. If the answer is YES at S702, the program proceeds to S308 where a print medium discharge instruction is issued. If the answer is NO at S702, the program ends so that no blank page is outputted. Since the page length managing process has been performed at S307, the page on which the page length managing process was performed will be "the next page."

{Blank Page Determining Process}

Figure 12:
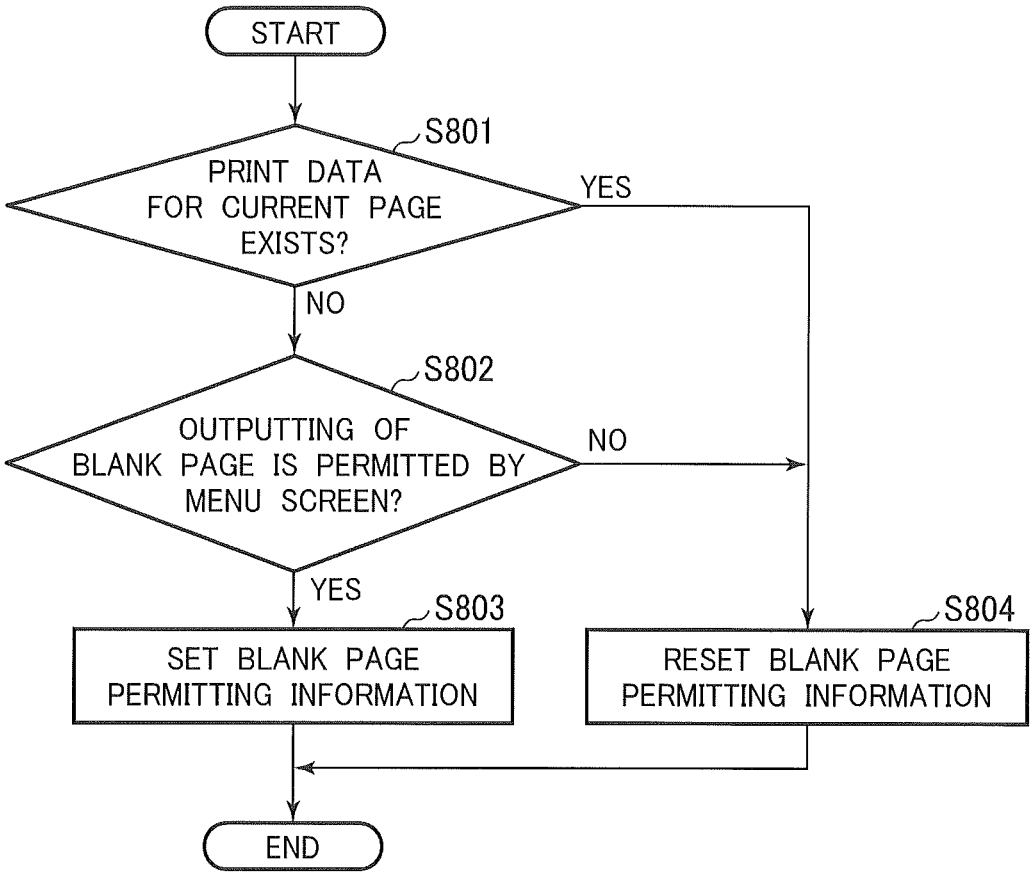
FIG. 12 is a flowchart illustrating a blank page determining process.

FIG. 12 is a flowchart illustrating the blank page determining process. The blank page determining process will be described with reference to FIG. 12. The blank page controller 203 makes a decision to determine whether the print data for the current page exists (S801). A check may be made based on a flag, which is configured to be set when the print data is parsed and reset when a discharge operation has been carried out, to determine whether the print data for the current page exists. If the answer is NO at S801, the program proceeds to S802. The answer NO at S801 implies that the cumulative position exceeds the page length of the paper and therefore the page is a blank page. In other words, when the cumulative position exceeds the page length of a page, if the print data does not exist for the page, that page is a blank page. If the print data exists (YES at S801), the program proceeds to S804.

If the answer is NO at S801, the blank page controller 203 makes a decision based on the information displayed on the menu screen to determine whether the outputting of a blank page is permitted (S802). If the outputting of a blank page is permitted, the program proceeds to S803. If the outputting of a blank page is not permitted, the program proceeds to S804.

If the answer is YES at S802, the blank page controller 203 sets the blank page permitting information (S803). If the answer is YES at S801 or if the answer is NO at S802, the blank page controller 203 resets the blank page permitting information (S804). The program then proceeds to S307 (FIG. 11).

{Effects}

As described above, the printer 1000*a* is capable of performing the management of a blank page. This is accomplished by modifying the control method according to the first embodiment. Therefore, the printer 1000*a* according to the second embodiment is capable of managing the outputting of a blank page even when a host PC has no specially designed middleware or means for managing the outputting of a blank page. Thus the printer 1000*a* reduces the time required for the blank page to be discharged and the time required for a page to be fed after discharging a blank page. Therefore, each job may be processed in a shorter time than the conventional apparatus.

{Modification}

The present invention has been described in terms of preferred embodiments. The invention may be modified in a variety of ways without departing the scope of the invention.

{Printer}

The control methods according to the first and second embodiments may also be widely applied to a serial printer which operates on a line-by-line basis in accordance with the character data and control commands, including line feed commands received from a host PC, and the paper may be advanced in a print medium feeding direction and discharged in a discharging direction opposite to the print medium feeding direction.

{Line-Feed Command Parser}

If the value held in the cumulative position holding buffer 401 is smaller than the page length (NO at S306), the line-feed command parser 202 according to the first and second embodiments terminates the printing process while leaving the amount of line feed placed on hold. In other words, at this time, the line-feed command parser 202 does not issue an instruction for performing the line feed, and starts parsing the next data or byte. However, when the value held in the cumulative position holding buffer 401 is smaller than the page length (YES at S306), if the host PC completes transmission of print data while the amount of line feed is being placed on hold or transmission of print data from the host PC is interrupted for some reason, the line-feed command parser 202 may perform a line feed operation a predetermined time after the interruption of the print data transmission. The manner in which the predetermined time is counted is well known in the art and a detailed description is omitted. Performing the line feed operation a predetermined time after the interruption of the print data transmission prevents the printer from continuing to hold the print data.

{Comparison}

Figures 13A, 13B:
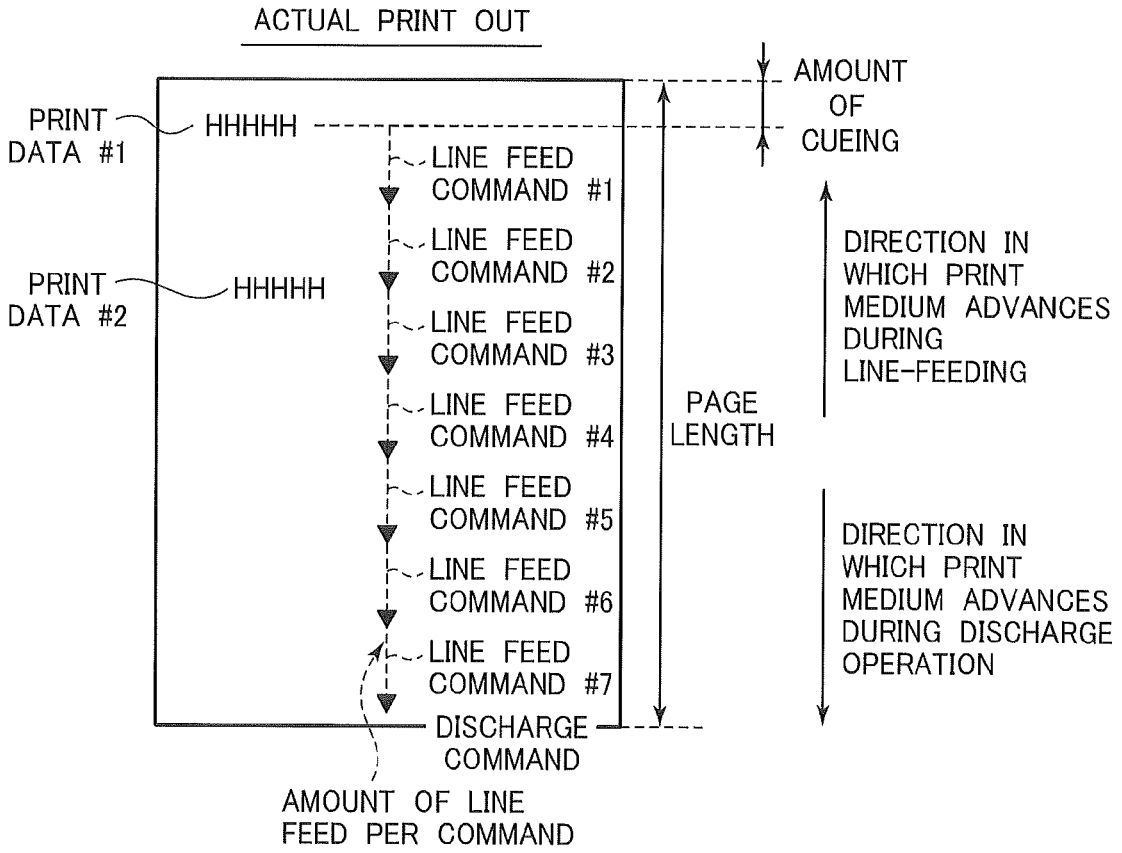
FIGS. 13A and 13B illustrate a comparison printer.

FIGS. 13A and 13B illustrate a comparison printer. Arrows indicate the movement of the print head 302 relative to the print medium. A description will be given of a comparison printer to which the control method according to the present invention is not applied. As shown in FIG. 13A, shortly after transmission of the final print data for a page, a host PC transmits line feed commands #3-#7, which are set by the application in the host PC, toward the end of the page. The host PC transmits a discharge command shortly after the line feed commands #3-#7. The received data sequence shown in FIG. 13A is often the case when the paper is advanced by line feed operations in the print medium feeding direction and is then discharged in a discharging direction which is the same as the print medium feeding direction.

Upon reception of received data having a sequence as shown in FIG. 13A, the printer performs a discharging operation after having printed the print data #2, which is the final line of the page. The discharging operation is performed such that the line feed commands #3-#7 are executed despite the fact that no character data to be printed is present, and then a discharge command is executed. This requires a longer time before the paper is discharged.

In contrast, if the line feeding of the paper is to be carried out in a direction opposite to the paper discharging direction, the printer according to the first embodiment maintains the line feed operation on hold until immediately before a printing operation of the parsed character data, and then performs the line feed operation immediately before the printing operation of the parsed character data, thereby eliminating the need for execution of unnecessary line feeds. Therefore, the printers 1000 and 1000*a* reduce the total time from receiving the print data to discharging the printed paper.

What is claimed is:

1. An image forming apparatus, comprising:

a memory that stores discharge direction information indicative of a discharge direction in which a print medium is discharged, page length information about the page length of a page of the print medium, and the position of a line on the print medium relative to a leading end of the page of print medium if a line feed operation is performed;

a receiving section configured to store printer control data and print data received from an external apparatus, the printer control data including line feed commands;

a position detector that outputs a detection signal indicative of a position of the leading end of the page of print medium in the image forming apparatus;

an image forming section configured to perform printing on the page of print medium and transporting the page of print medium;

controller means reading and for parsing the print data and the printer control data until the receiving section no longer holds the print data and the printer control data, and then controlling the image forming section so that the image forming section feeds the page of the print medium to a print start position in accordance with the detection signal, and then prints the print data on the page of print medium in accordance with the parsed print data and the printer control data;

wherein the controller means includes determination means for determining whether the discharge direction information indicates a discharge direction opposite to a line feed direction in which the page of print medium is advanced by the line feed operation and whether the parsed printer control data is a line feed command, and wherein the controller means further includes line-feed command parser means for adding the amount of line feed specified by the line feed command to the position on the print medium held in the memory if the determination means determines that the discharge direction is opposite to the line feed direction and that the parsed printer control data is the line feed command, and for placing the line feed operation based on the added result on hold if the position of the line on the print medium after addition is within the page length.

2. The image forming apparatus according to claim 1, wherein when the memory holds an amount of line feed, the controller performs a line feed operation in accordance with the amount of line feed held in the memory immediately before printing a subsequent character, and then allows the image forming section to print the subsequent character.

3. The image forming apparatus according to claim 2, wherein the controller means further includes a blank page controller; and wherein if the amount of line feed held in the memory is not shorter than the page length information described by the page length information, the blank page controller determines that a page on which the amount of line feed should be performed is a blank page, and does not allow the image forming section to perform printing.

4. The image forming apparatus according to claim 2, wherein if the position on the print medium after addition is not within the page length, the controller means does not perform a line feed operation in accordance with the amount of line feed held in the memory and drives the image forming section to discharge the print medium without performing a line feed operation for a first portion of the amount of line feed that should be carried out within the page of the print medium, and then maintains a second portion of the amount of line feed in excess of the page length as an amount of line feed for the next page of the print medium.

5. The image forming apparatus according to claim 1, wherein when the memory holds an amount of line feed, the controller does not perform a line feed operation in accordance with the amount of line feed held in the memory, and drives the image forming section to discharge the page of print medium.

6. The image forming apparatus according to claim 5, wherein if the position on the print medium after addition is not within the page length, the controller means does not perform a line feed operation in accordance with the amount of line feed held in the memory and drives the image forming section to discharge the print medium without performing a line feed operation for a first portion of the amount of line feed that should be carried out within the page of the print medium, and then maintains a second portion of the amount of line feed in excess of the page length as an amount of line feed for the next page of the print medium.

7. The image forming apparatus according to claim 5, wherein the controller means further includes a blank page controller; and wherein if the amount of line feed held in the memory is not shorter than the page length information described by the page length information, the blank page controller determines that a page on which the amount of line feed should be performed is a blank page, and does not allow the image forming section to perform printing.

8. The image forming apparatus according to claim 1, wherein if the position on the print medium after addition is not within the page length, the controller means does not perform a line feed operation in accordance with the amount of line feed held in the memory and drives the image forming section to discharge the print medium without performing a line feed operation for a first portion of the amount of line feed that should be carried out within the page of the print medium, and then maintains a second portion of the amount of line feed in excess of the page length as an amount of line feed for the next page of the print medium.

9. The image forming apparatus according to claim 8, wherein the controller means further includes a blank page controller; and wherein if the amount of line feed held in the memory is not shorter than the page length information described by the page length information, the blank page controller determines that a page on which the amount of line feed should be performed is a blank page, and does not allow the image forming section to perform printing.

10. The image forming apparatus according to claim 1, wherein the controller means further includes a blank page controller; and wherein if the amount of line feed held in the memory is not shorter than the page length information described by the page length information, the blank page controller determines that a page on which the amount of line feed should be performed is a blank page, and does not allow the image forming section to perform printing.

11. A method of discharging a print medium, comprising:

receiving print data including printer control data and character data from an external apparatus, the print control data including line feed commands, a discharge direction in which a page of print medium should be discharged after printing, and a page length of the page of the print medium;

feeding the page of print medium to a print start position;

holding, in a memory, a position on the page of print medium when the page of print medium is at the print start position;

parsing the print data;

printing parsed character data when the parsed print data is character data; and determining whether or not to conduct an adding step in which the amount of line feed specified by a line feed command is added to the position of the print medium held in the memory, the determination being based on whether first and second conditions exist, the first condition being that the parsed data is the line feed command and the second condition being that the discharge direction is opposite to a line feed direction in which the page of print medium is advanced during a line feed operation, wherein the adding step is conducted if the first and second conditions are determined to exist and the added result is placed on hold if the position on the print medium after addition is within the page length.

12. The image forming apparatus according to claim 1, wherein if the position of the line on the print medium after addition is out of the page length, the controller means controls the image forming section so that the image forming section discharges the page of the print medium.

* * * * *